United States Patent [19]

Tichy

[11] Patent Number: 4,534,716

[45] Date of Patent: Aug. 13, 1985

[54] DOWN HOLE PUMP

[76] Inventor: James B. Tichy, P.O. Box 746 Waldo Point, Sausalito, Calif. 94965

[21] Appl. No.: 536,917

[22] Filed: Sep. 27, 1983

[51] Int. Cl.[3] ..... F04B 9/08

[52] U.S. Cl. ..... 417/469; 91/217

[58] Field of Search ..... 91/217, 216 R, 216 B; 417/469, 466

[56] References Cited

U.S. PATENT DOCUMENTS

| | | | |
|---|---|---|---|
| 466,094 | 12/1891 | Evered | 417/469 |
| 719,454 | 2/1903 | Francke | 417/469 X |
| 1,013,200 | 1/1912 | Menningen | 417/466 |
| 2,361,316 | 10/1944 | Newton et al. | 417/469 X |
| 2,979,725 | 4/1961 | Wandel et al. | 91/217 X |
| 2,980,027 | 4/1961 | Dulaney | 91/217 X |

*Primary Examiner*—Leonard E. Smith

*Attorney, Agent, or Firm*—Townsend & Townsend

[57] ABSTRACT

A positive displacement pump includes a cylindrical housing which is divided in half by a partition. Each end of the housing lies proximate to an end plate to define peripheral inlet openings into each of said halves. Axial outlets and pistons are also provided for each half of the chamber. By including a mechanism for driving the pistons in unison and opening and closing the peripheral inlets and axial outlets in a particular order, pumping action can be achieved. The pump disclosed is particularly useful from down hole oil pumping applications.

4 Claims, 18 Drawing Figures

DOWN HOLE PUMP

BACKGROUND OF THE INVENTION

1. Field of the Invention

The present invention relates generally to pumps and, more particularly, to a positive displacement pump having a peripheral inlet to facilitate handling viscous fluids.

2. Description of the Prior Art

Positive displacement pumps capable of recovering oil from depths up to 10,000 feet are typically sucker rod pumps equipped with a plunger, travelling ball valve and standing ball valve. The delivery of the oil or other well fluids to the surface occurs only on the upstroke of the plunger, and production ceases as the plunger lowers for another charge. For higher production rates, there are double-acting piston pumps which can be operated up to depths of 18,000 feet. Delivery of the well fluid to the surface occurs on both the upstroke and the downstroke of the piston, which requires an intake port both at the top and at the bottom of the pump. However, the need to bypass fluid around the ball valve and piston on the downstroke of the piston requires intricate manifolding which complicates the architecture of the pump. The resulting constricted inlet passages are subject to vaporlock stall and cavitation damage.

Thus, a bottom hole double-acting piston pump which provides larger and more efficient intake passages and ports for the efficient intake of well fluids under a wide range of well conditions would be of great value.

U.S. Pat. No. 4,386,889 issued on June 7, 1983, to the inventor herein, discloses a positive displacement pump comprising an enclosure having parallel walls and a plurality of concentric annular rings reciprocatably mounted therebetween. By reciprocating the rings in a predetermined sequence, fluid is caused to flow through a series of inwardly or outwardly propagating chambers defined by the rings

SUMMARY OF THE INVENTION

The present invention provides a positive displacement pump capable of transporting highly viscous fluids at relatively high volumetric flow rates. The pump comprises an elongate chamber, typically a cylinder, having a piston arranged for axial reciprocation therein. A peripheral opening is provided at at least one end of the chamber so that the fluid being pumped is drawn into the chamber as the piston is moved away from the inlet opening. The peripheral opening can be made very wide to accommodate highly viscous fluids. A mechanism is provided to seal the peripheral opening after the pumping chamber has been filled, and an axial outlet opening is provided in the chamber for discharge of the fluid as the piston is driven in the opposite direction. A second sealing mechanism is provided to close the axial outlet opening while the pumping chamber is being filled. Both the peripheral sealing mechanism and the axial sealing mechanism are coupled to the piston drive mechanism so that the openings are actuated in the proper sequence.

DESCRIPTION OF THE PREFERRED EMBODIMENTS

Figure 1:
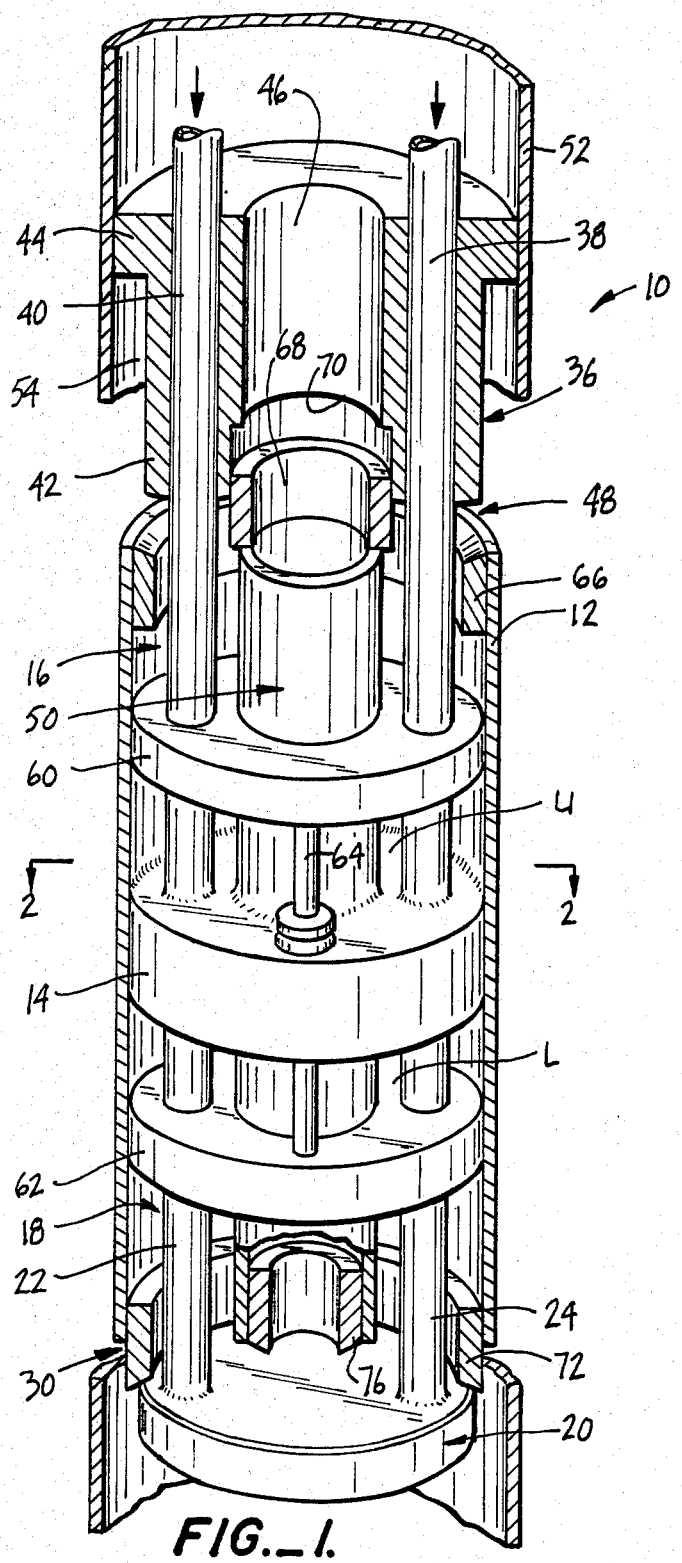
FIG. 1 is a perspective view of a first embodiment of the pump of the present invention illustrated with portions broken away.

Referring to FIGS. 1–5, a first embodiment 10 of the pump of the present invention will be described. The pump 10 comprises a cylindrical housing 12 having a fixed partition 14 at its center. The partition 14 divides the interior of the cylindrical housing 12 into upper and lower volumes 16 and 18, respectively. As referred to hereinafter in the specification and the claims, the terms "upper" and "lower" will refer to the pump as illustrated in the drawings. A lower end plate 20 is connected to the fixed partition 14 by a pair of connector rods 22 and 24. The lower end plate 20 has an outer diameter generally equal to the inner diameter of the cylindrical housing 12. The lower end of the cylindrical housing 12 terminates above the lower end plate 20 to define a peripheral opening 30 (best illustrated in FIGS. 4D and 4E) into the lower volume 18. The lower peripheral opening 30 defines one of the two pump inlets.

An upper end plate 36 is connected to the fixed partition 14 by a pair of fluid supply tubes 38, 40. As will be described in detail hereinafter, supply tubes 38 and 40 provide the hydraulic fluid necessary for driving the pump. The upper end plate 36 includes a shank portion 42 having an outer diameter approximately equal to the inner diameter of the cylindrical housing 12 and a flanged portion 44. An axial passage 46 is formed through the end plate 36 and defines the pump outlet port. The lower end of the shank portion 42 of the end plate 36 is spaced apart from the upper end of the cylindrical housing 12 to define a peripheral opening 48.

An axial outlet tube 50 is aligned with the axial passage 46 in the upper end plate 36 and terminates proximate each end of the cylindrical housing 12. The lower end of the outlet tube 50 is spaced upward from the lower end plate 20 to allow fluid discharged from the lower volume 18 to flow upward through the tube 50 and into the axial passage 46. The upper end of the outlet tube 50 is spaced apart from the lower end of the upper end plate 36 to similarly allow fluid in the upper volume 16 to be discharged into the axial passage 46.

Pump 10 is encased in a cylindrical well tubing 52. Flange 44 seals against the interior of the tubing 52 and defines an annular volume 54 between the interior wall of the casing and the pump 10. The tubing 52 may terminate at the flange 44, allowing the well fluid to flow directly into the upper and lower intakes 48 and 30. Alternatively, the tubing 52 may extend downward to or beyond lower plate 20 and include a plurality of perforations (not shown) to allow fluid from the exterior to flow into the annular volume 54. The fluid is then able to flow into both the peripheral openings 30 and 48, as will be described hereinafter.

The elements of the pump 10 described to this point remain stationary relative to one another during operation of the pump. The pump also includes a number of movable components as will now be described. An upper piston 60 is reciprocatably mounted in the upper volume 16 on the supply tubes 38, 40 and the outlet tube 50. A second piston 62 is reciprocatably mounted in the lower volume 18 on the connector rods 22, 24 and the outlet tube 50. The pistons 60 and 62 are connected by a pair of tie rods 64 and 65 (only 64 being illustrated in FIG. 1) so that they move in unison under the influence of the drive mechanism, as will be described hereinafter.

An inlet valve ring 66 is slidably mounted at the upper end of the cylindrical housing 12. As illustrated in FIG. 1, the ring 66 is in its lowermost position, leaving the peripheral inlet 48 fully open. A retaining shoulder (not shown) is provided on the interior wall of the cylindrical housing 12 to limit the downward movement of the valve ring 66. The ring 66 will move upward to close the peripheral opening 48 during the discharge cycle of the piston 60, as will be described hereinafter. An outlet valve ring 68 is slidably mounted in the lower end of the axial passage 46. The outlet ring 68 is shown in its lowermost position in FIG. 1. A shoulder 70 is formed in the passage 46 to limit the upward movement of the ring 68. As described hereinafter, the ring 68 will open during the fluid discharge cycle from the upper volume 16.

A second inlet valve ring 72 is provided at the lower end of the cylindrical housing 12 and is capable of mating with the end plate 20. The ring is illustrated in its lowermost (closed) position in FIG. 1. A retaining shoulder (not illustrated) is provided on the interior wall of the cylindrical housing 12 to limit the upward motion of the ring 72. An outlet valve ring 76 is slidably mounted in the lower end of the outlet tube 50. The outlet ring 76 is shown in its upper (open) position in FIG. 1. A retaining shoulder (not shown) is provided to limit its upward movement beyond this point. In its lowermost (closed) position, the lower end of the outlet ring 76 mates against the end plate 20 to prevent fluid in the lower chamber 18 from entering the outlet tube 50.

The pump operates by reciprocating the piston assembly 60, 62, as will now be described. The reciprocation is provided by pumping a driving fluid into the interstitial volumes between the partion 14 and the pistons 60 and 62. By introducing the driving fluid beneath the upper piston 60 into upper driving cavity U, the piston assembly (comprising the pistons 60 and 62 and the connecting rods 64 and 65) is caused to rise. By introducing the driving fluid on top of the lower piston 62 into lower driving cavity L, the piston assembly is caused to lower.

Figure 2:
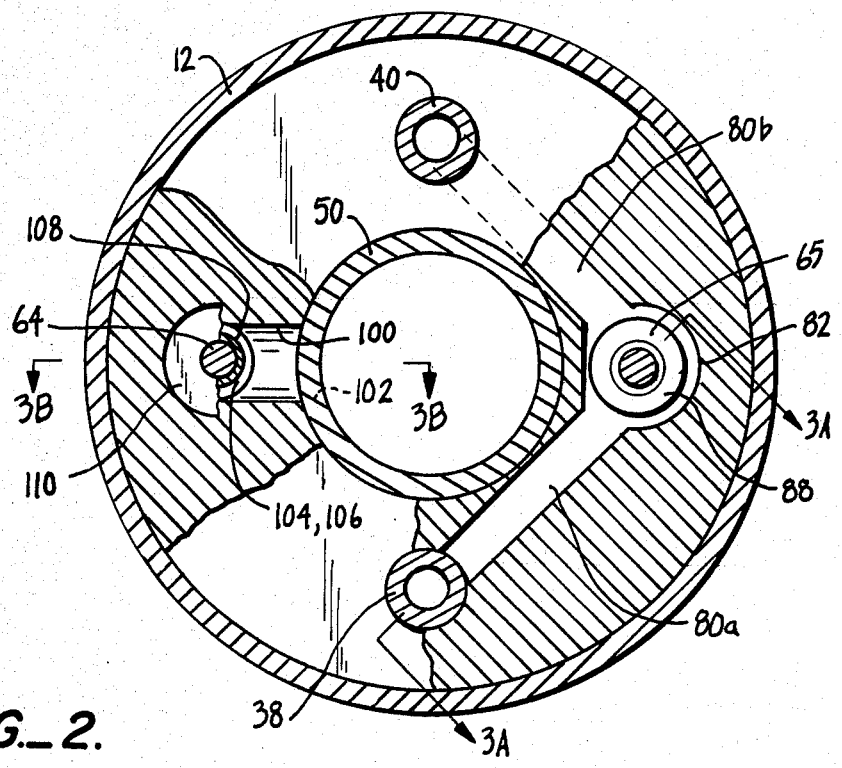
FIG. 2 is a sectional view of the pump taken along the line 2—2 of FIG. 1.
Figure 3A:
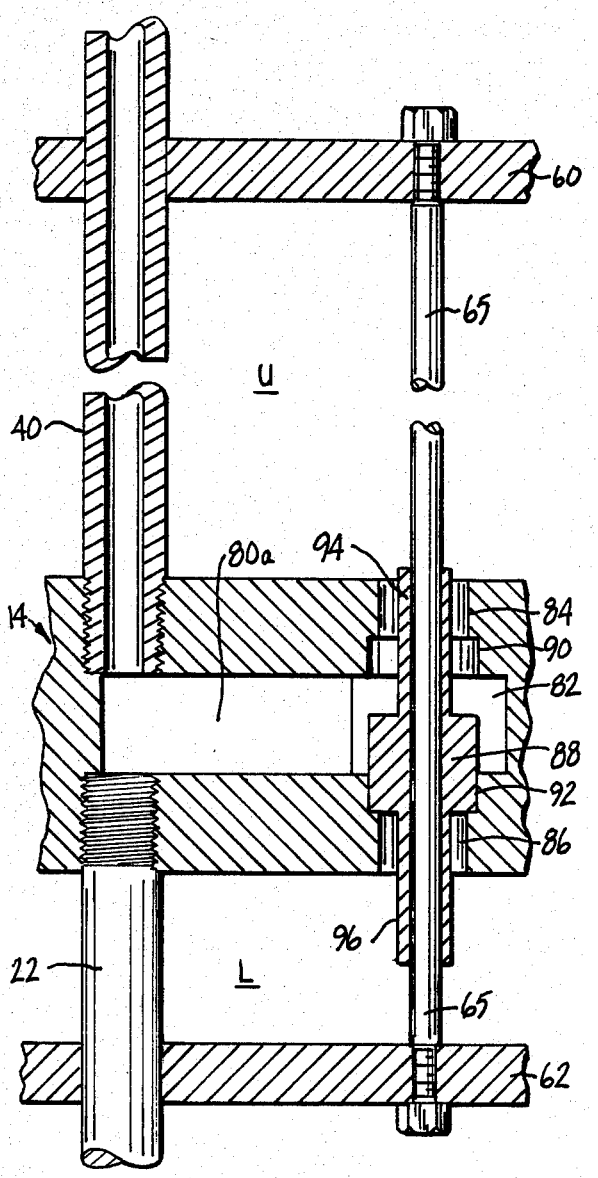
FIG. 3A is a sectional view taken across line 3A—3A of FIG. 2.
Figure 3B:
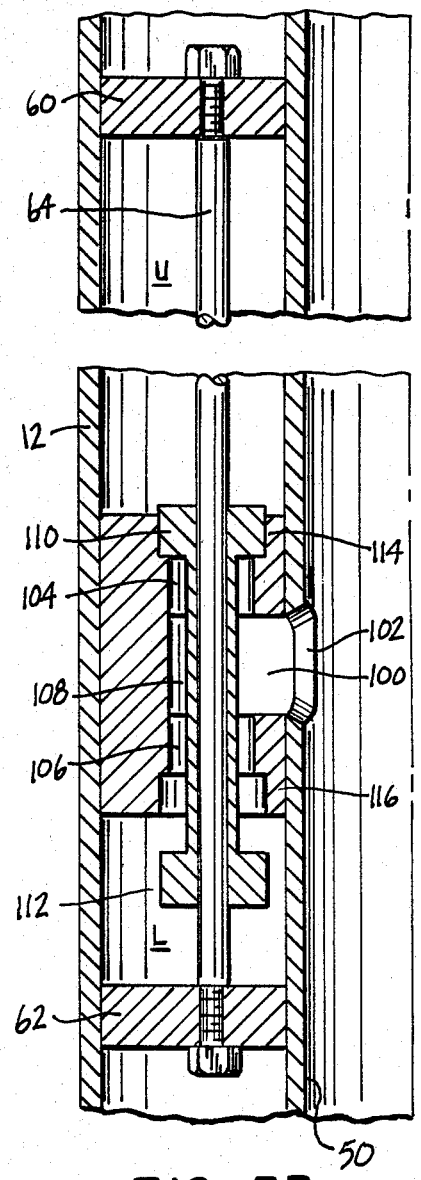
FIG. 3B is a sectional view taken across line 3B—3B of FIG. 2.

Referring now in particular to FIGS. 2, 3A and 3B, the structure of the fixed partition 14 will be described in detail. The partition 14 includes internal passages and valving as necessary to direct the driving fluid alternately between the upper driving cavity U and lower driving cavity L. Driving fluid is supplied to the partition 14 by the fluid supply tubes 38 and 40 which terminate in an internal passage 80 formed in the partition 14. The passage 80 includes a first leg **80*a* and second leg 80*b* which meet at an enlarged junction 82. Vertical passages 84 and 86 are formed in the partition 14 and aligned with the junction 82. A valve plug 88 is slidably mounted on the tie rod 65 which runs axially through the junction 82 and passages 84 and 86. Valve seats 90 and 92 are formed in the passages 84 and 86, respectively, so that the plug 88 can seat to block the flow of driving fluid to one side of the partition 14 while allowing such flow to the other side of the partition. The valve plug 88 includes an upper cylindrical extension 94 and a lower cylindrical extension 96 which are engaged by the pistons 60 and 62, respectively, to shift the valve plug 88** position, as will be described further hereinafter.

Referring now in particular to FIGS. 2 and 3B, a second internal passage 100 is formed in the body of the partition 14 to allow discharge of the driving fluid (from either the upper or lower driving cavities, U, L) into the axial outlet tube 50. The passage 100 communicates at its inner end through a port 102 formed in the outlet tube 50. A pair of vertical passages 104 and 106 connect the internal passage 100 to the upper and lower driving cavities U, L, respectively.

A plug 108 having an upper seating surface 110 and lower seating surface 112 is slidably mounted on the tie rod 64 which runs axially through the passages 104 and 106. The seating surfaces 110 and 112, in turn, are received in enlarged seats 114 and 116 formed in passages 104 and 106, respectively. The spacing between the seating surfaces 110 and 112 is such that when one of the surfaces 110 or 112 is mated in the corresponding seat 114 or 116, the other valve seat will be open. As illustrated in FIG. 3B, the upper seating surface 110 is closed, while the lower seating surface 112 is open. In this configuration, driving fluid from the lower driving cavity U is able to flow through passages 106 and 100 into the outlet tube 50.

Figure 4A:
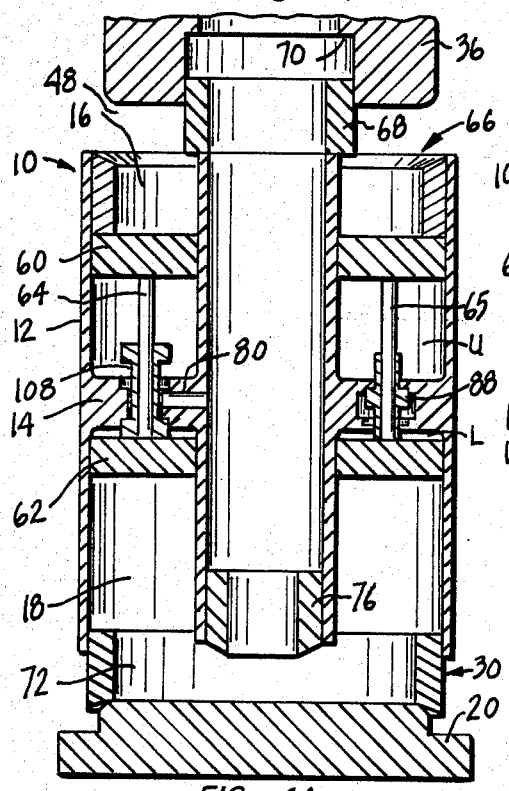
FIGS. 4A–4E are schematic illustrations of the embodiment of FIG. 1 illustrating the manner of operation of the pump.
Figure 4B:
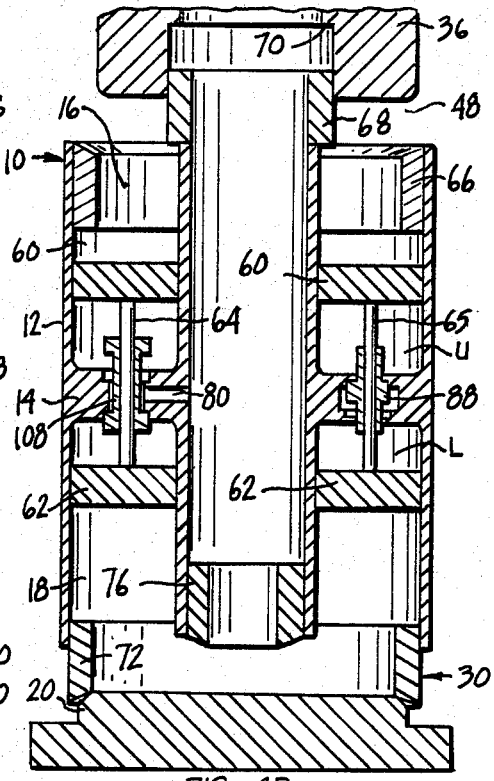

Referring now to FIGS. 4A–4B, the operation of the pump 10 will be described. The illustrations of FIGS. 4A–4E are schematic and the detailed construction of the pump is not shown. In particular, the internal passages in the partition 14 are not completely illustrated. It will be understood, however, that such passages are necessary to direct the driving fluid to drive the pistons 60 and 62.

Figure 4C:
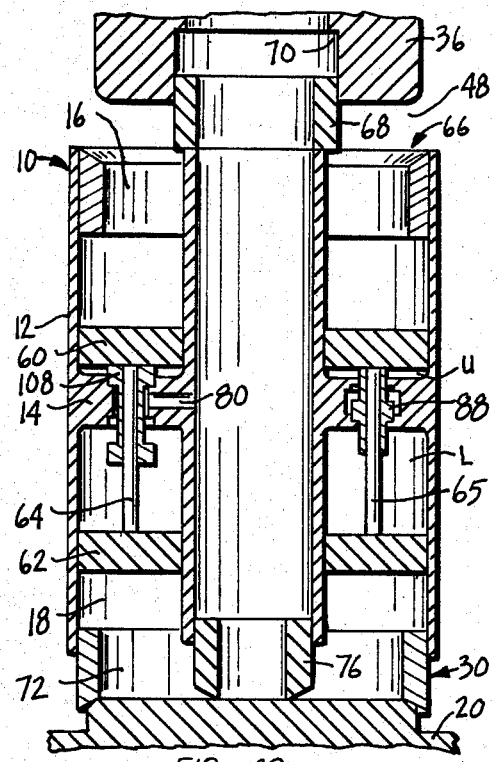
Figure 4D:
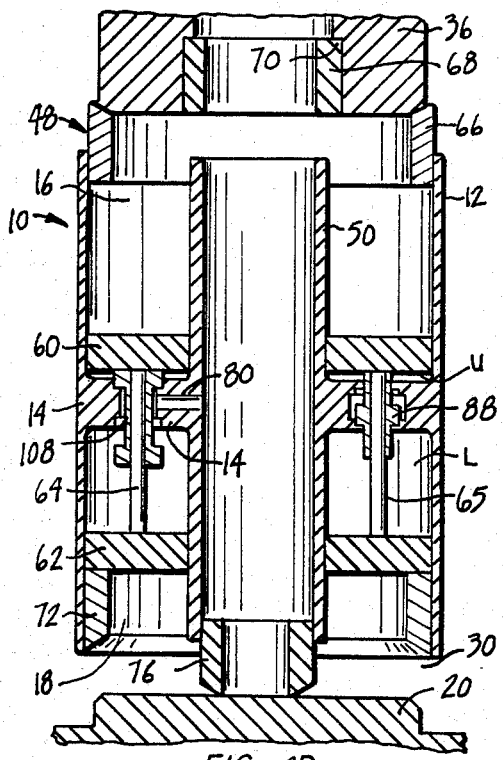
Figure 4E:
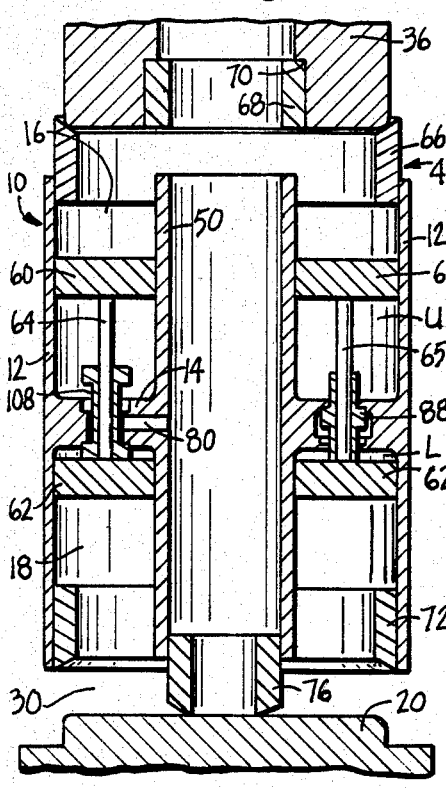

In FIG. 4E, pump 10 is just beginning a downward stroke of the piston assembly 60, 62. The suction pressure created by descending piston 60 decreases the pressure on the lower face of valve ring 66. The resulting pressure differential between the fluid on the outside of the pump 10 and the upper (volume) pumping cavity 16 opens (lowers) the inlet valve ring 66 to allow entry of the fluid being pumped. Similarly, the pressure differential between the upper pumping cavity 16 and the interior of the outlet tube 50 causes the outlet valve ring 68 to close (lower). Thus, as the piston assembly 60, 62 lowers, fluid will be drawn into the upper pumping cavity 16 from the exterior of the pump through inlet 48, and valve rings 66 and 68 will assume the configuration illustrated in FIG. 4A.

The arrangement in the lower pumping cavity 18 as piston assembly 60, 62 begins its ascent (FIG. 4E) is just the opposite. The fluid trapped in the lower pumping cavity 18 is pressurized and expelled by the downward force of the piston 62. Fluid expelled from cavity 18 causes a hydrodynamic pressure differential between the cavity 18 (at a higher relative pressure) and the exterior of the cavity (at a lower relative pressure). This pressure differential causes the inlet valve ring 72 to close (lower) and the outlet valve ring 76 to open (raise), and the valve rings 72 and 76 assume the positions illustrated in FIG. 4B. Thus, the fluid is able to flow from the lower pumping cavity 18 into the lower end of the axial outlet tube 50.

The piston assembly 60, 62 is being driven by pumping fluid into the lower driving cavity L. As described hereinbefore, the fluid enters from the supply tubes 38 and 40 to the internal passage 80. The valve 88 is in its raised position which directs the drive fluid above the lower piston 62. The pumping fluid which is present beneath the upper driving piston 60 is discharged through the second internal passage 100 by the valve 108 which is also in its raised position.

Referring now to FIG. 4B, the piston assembly 60, 62 has moved downward through about one-third of the downward pumping stroke. The valve rings 66, 68, 72 and 76 remain in the same position as illustrated in FIG. 4A, as do the driving fluid valves 88 and 108. The upper pumping cavity 16 continues to fill with the fluid being pumped, while the contents of the lower pumping cavity 18 are being discharged into the outlet tube 50.

FIG. 4C illustrates the situation after the piston assembly 60, 62 reaches the downwardmost point of its stroke. The upper piston 60 engages the valves 88 and 108 and lowers them, as illustrated. The pumping fluid is thus directed to the upper pumping cavity U, while the lower pumping cavity L (which is filled with driving fluid) is opened to the outlet tube 50. The valve rings 66, 68, 72 and 76, however, remain in the same positions as in FIGS. 4A and 4B until the piston assembly 60, 62 begins its upward travel.

The situation as the piston assembly 60, 62 begins to move upward is illustrated in FIG. 4D. Fluid is initially expelled from cavity 16 through opening 48, but the hydrodynamic differential pressure caused by the outflow of fluid forces valve ring 66 to close. The pressure in the upper pumping cavity 16 immediately increases. The resulting increased pressure will cause outlet valve 68 to open (raise). The fluid in the upper pumping cavity 16 is thus discharged into the axial passage 46.

In the lower pumping cavity 18, a hydrodynamic differential pressure is created as fluid begins to flow into the cavity. Such differential pressure will act to close outlet valve ring 76 and to open inlet valve ring 72. This allows the pumped fluid to flow into the lower pumping cavity 18 as the pistons 60, 62 are raised.

FIG. 4E illustrates the situation as the piston assembly 60, 62 reaches its uppermost point of travel, before the direction of travel has reversed The positions of drive fluid valves 88 and 108 are reversed relative to their initial position, as in FIGS. 4A and 4B. This will, of course, cause the piston assembly 60, 62 to start moving downward which will reverse the positions of valve rings 66, 68, 72 and 76. Until such downward travel commences, however, the valve rings 66, 68, 72 and 76 remain in the same position as in FIG. 4D. The pump will continue to cycle as illustrated in FIGS. 4A–4E as long as driving fluid is supplied to the partition 14.

As just described, the driving fluid is discharged to the return tube 50 and, thus, is pumped to the surface along with the fluid being pumped. Therefore, the driving fluid and pumped fluid should be compatible. In the case of oil, various hydraulic fluids would be suitable.

A second embodiment 200 of a pump constructed in accordance with the present invention is illustrated in FIGS. 5–8. The pump 200 is similar to the first embodiment 10 with the major difference being that the four valve rings 66, 68, 76 and 72 are not utilized. Instead, the pump 200 is provided with a cylindrical housing 212 and an axial outlet tube 250 which are capable of reciprocation relative to a fixed partition 214. In this way, the inlet and outlet passages to the pump can be opened and closed without the use of separate valve rings. In describing the second embodiment, components which are analogous to components previously described in the description in the first embodiment 10 will be given the same reference number with a prefix 2. Thus, the axial outlet tube in the second embodiment will be given reference number 250, while the upper pumping cavity will be given reference number 216. The upper and lower driving cavities will retain the U and L references, respectively.

The pump 200 includes upper and lower end plates 236 and 220, respectively. The upper end plate 236 is mounted on a pair of fluid supply tubes 238 and 240 which are connected at their lower ends to the fixed partition 214, as will be described in more detail hereinafter. The lower end plate 220 is attached to the fixed partition 214 by a pair of connector rods 222 and 224. The pump is enclosed in a casing 252 and fluid flows into the annular volume 254 between the casing and the pump.

The fixed partition 214 includes upper and lower flanges 300 and 302 to define an annular volume 304 between the partition and the inner wall of the cylindrical housing 212. A ring 306 is formed about the middle of the interior wall of the cylindrical housing and is received in the annular volume 304. In this way, the cylindrical housing 212 is free to reciprocate upward and downward within the limits of the upper and lower end plates 236 and 220, respectively.

Figure 5:
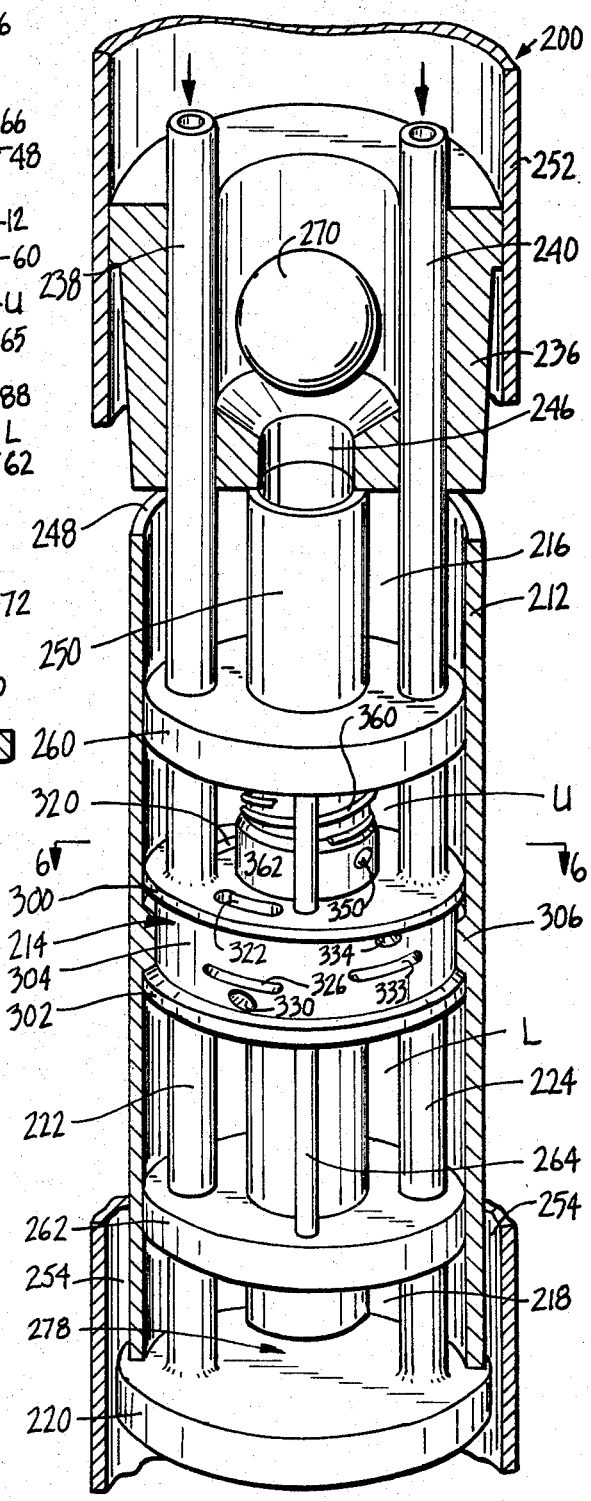
FIG. 5 is a perspective view of a second embodiment of the pump of the present invention with portions broken away.

When the cylindrical housing 212 is in its fully downward position, as illustrated in FIG. 5, an upper peripheral opening 248 is provided. The opening 248 is the inlet to the upper pumping cavity 216. When the cylindrical housing 212 is in its fully upward position, a lower peripheral opening 230 (FIGS. 8D and 8E) is formed. The opening 230 defines an inlet into the lower pumping cavity 218.

The axial outlet tube 250 is also free to reciprocate upward and downward between the end plates 236 and 220. The mounting which allows this will be described in detail hereinafter. In its raised position, as illustrated in FIG. 5, the upper end of the outlet tube 250 seals against an axial passage 246 formed in the upper end plate 236. The axial passage 246 provides the pump outlet to the casing 252 which is connected to the collection vessel at the surface in the conventional manner. When the outlet tube 250 is sealed at its upper end, it is raised above the lower end plate 220 to define a tube inlet 278 which allows fluid in the lower pumping chamber 218 to enter the lower end of the axial outlet tube 250. In this way, the fluid in the lower pumping cavity 218 can be discharged into the casing 252.

Figures 8A, 8B, 8C:
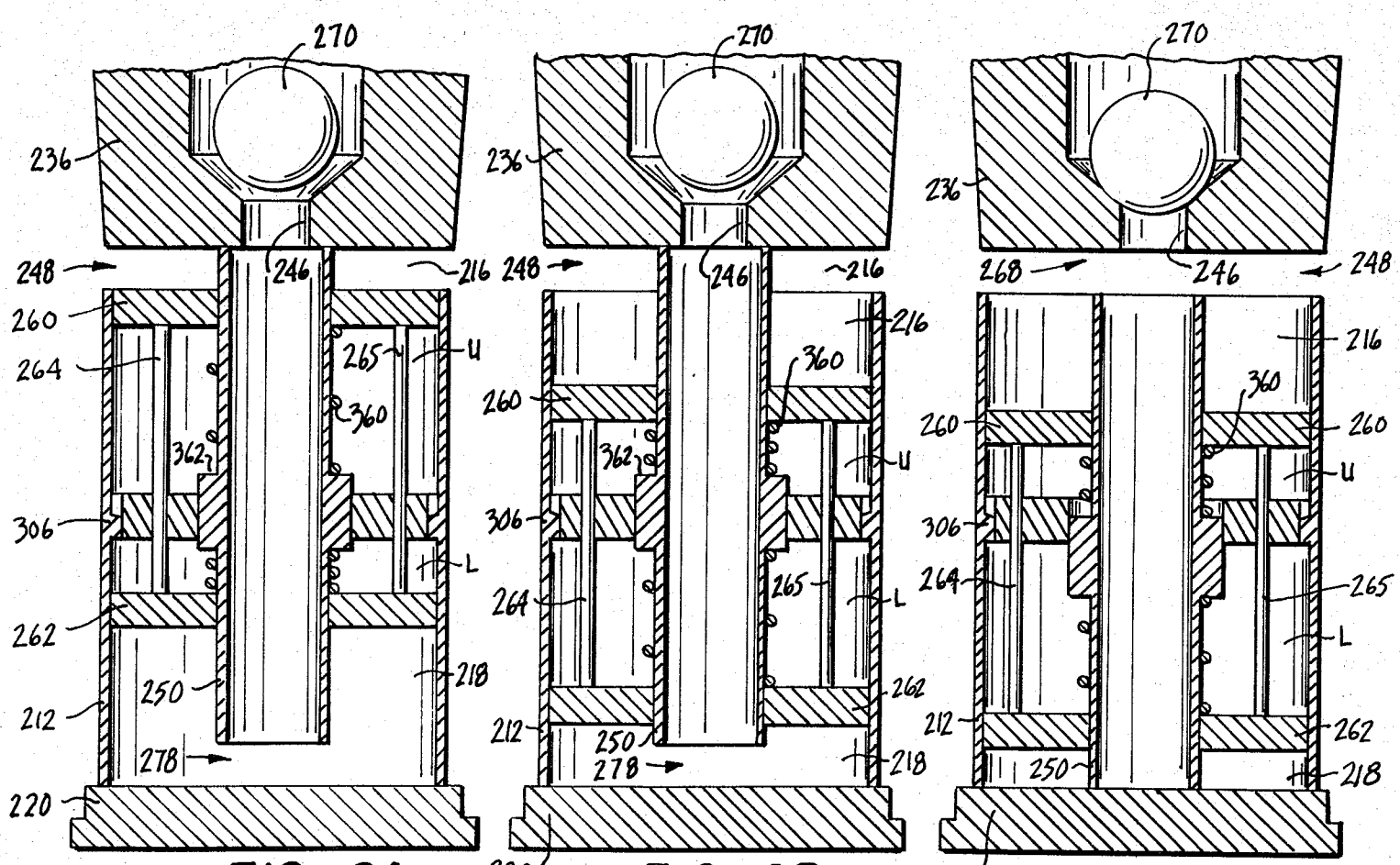
FIGS. 8A–8E are schematic illustrations of the embodiment of FIG. 5 illustrating the manner of operation of the pump.
Figure 8D:
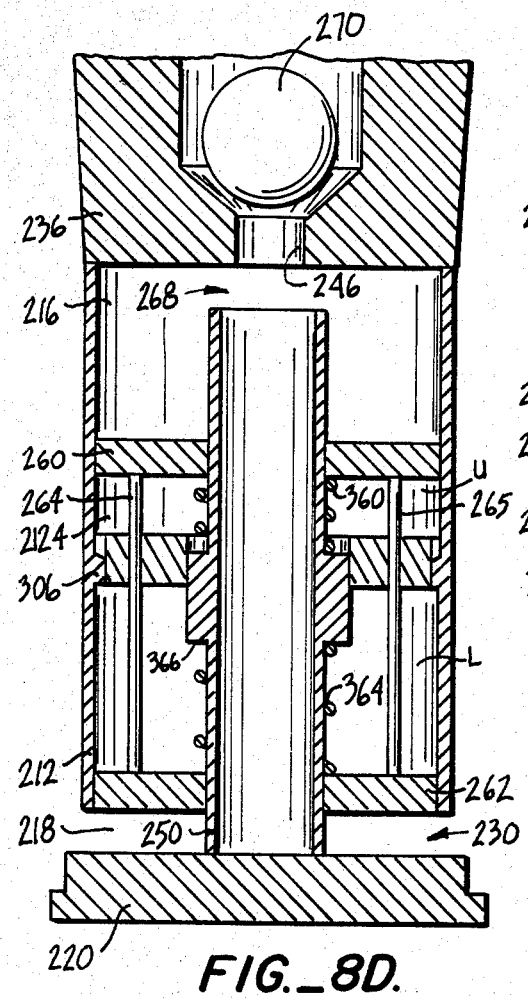
Figure 8E:
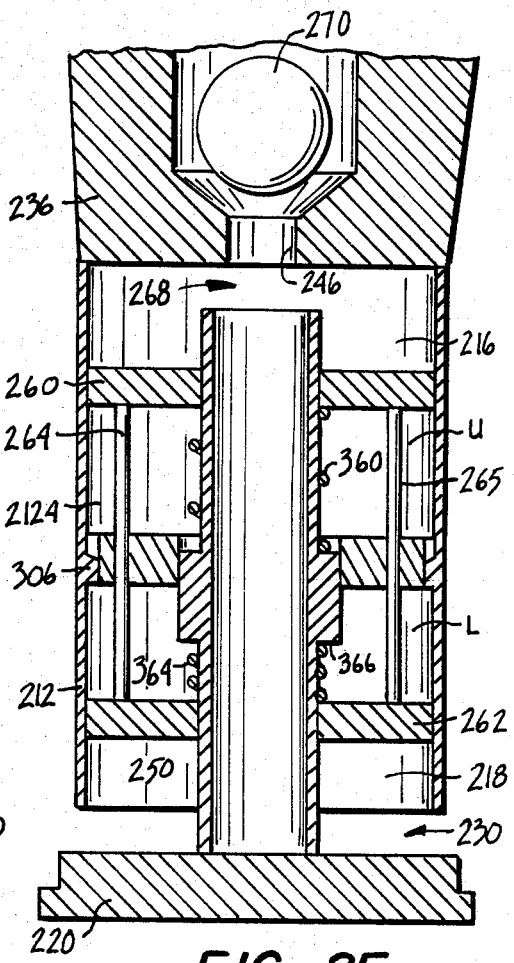

When the outlet tube 250 is in its lowered position (as illustrated in FIGS. 8C–8E) inlet 278 to the lower end of the tube is blocked and an inlet 268 to axial passage 246 is formed. In this way, fluid from the upper pumping chamber 216 can be discharged through axial passage 246 and into the casing 252.

The pump 200 is provided with an upper piston 260 and lower piston 262 which are connected by tie rods 264 and 265. The lower face of the upper piston and upper face of the partition 214 together define an upper driving cavity U which receives the driving fluid. Similarly, the lower face of the partition 214 and the upper face of the lower piston 262 together define a lower driving cavity L. As with the first embodiment, driving fluids supplied through tubes 238 and 240 will be alternately directed to the upper driving cavity U and lower driving cavity L in order to reciprocate the piston assembly 260, 262.

Figure 6:
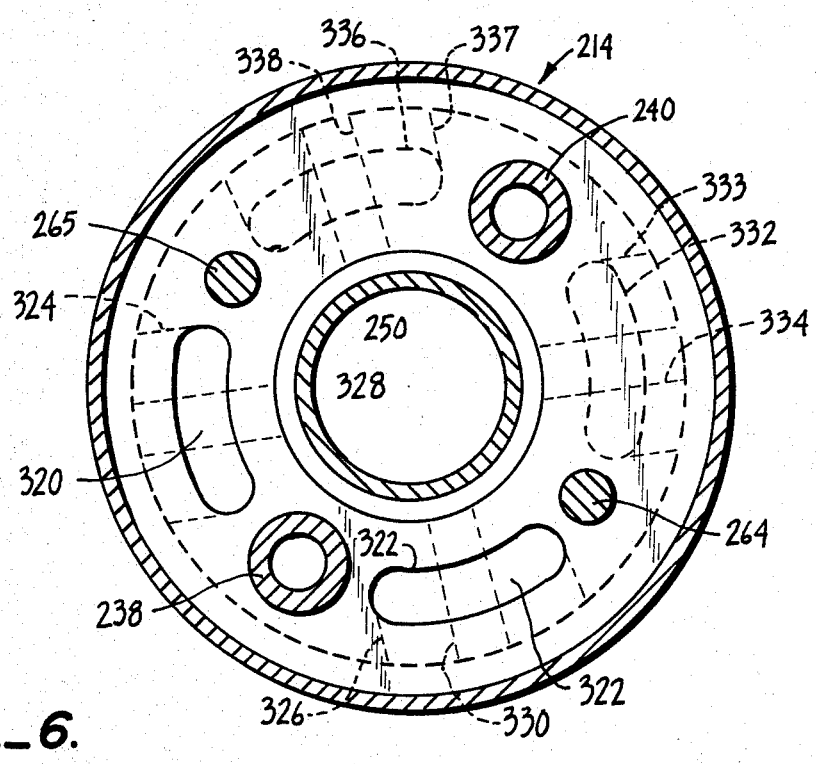
FIG. 6 is a cross-sectional view taken along line 6—6 of FIG. 5.
Figure 7A:
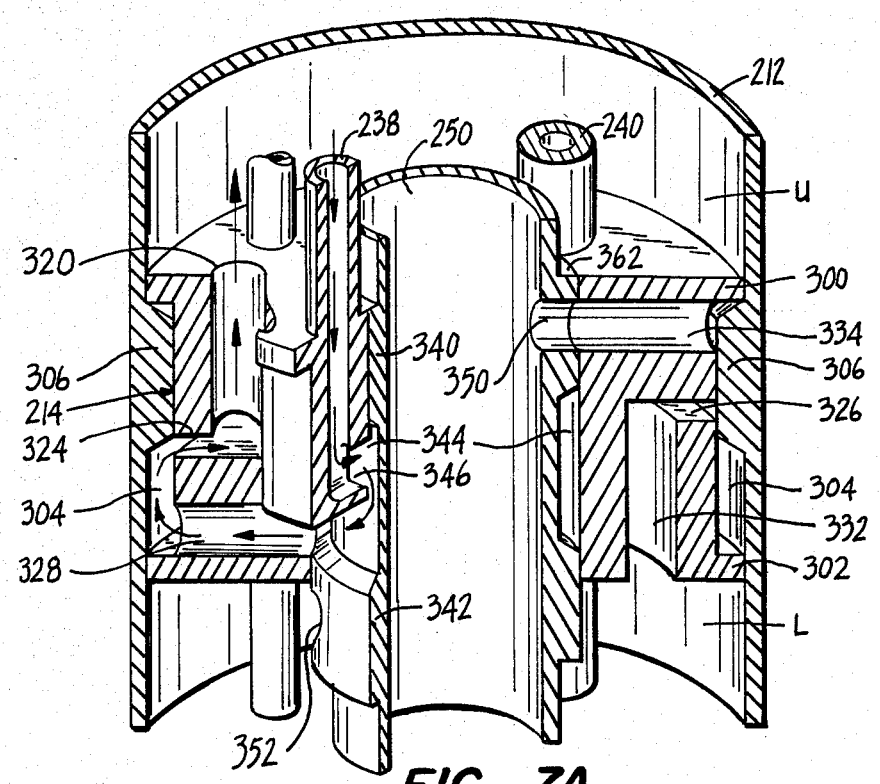
FIG. 7A is a cross-sectional view taken along line 7A—7A of FIG. 6.
Figure 7B:
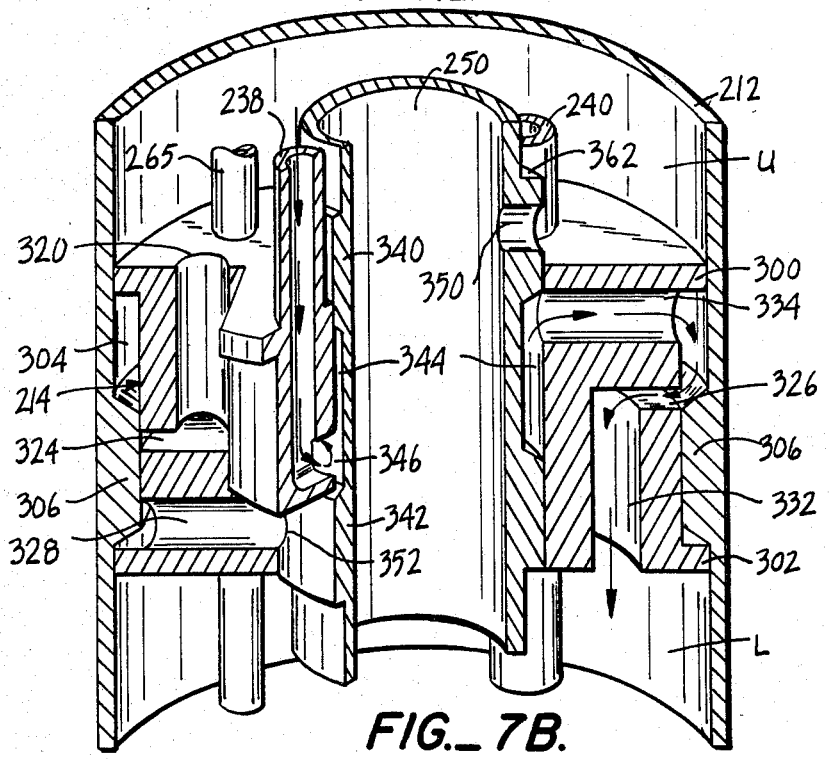
FIG. 7B is a cross-sectional view taken along line 7B—7B of FIG. 6.

Referring now in particular to FIGS. 6, 7A and 7B, the construction of the partition 214 will be described in detail. The partition 214 includes a pair of upper discharge ports 320 and 322 for supplying pumping fluid to the upper pumping cavity U. Upper discharge port 320 is internally connected to a side discharge port 324 (FIG. 7A and 7B), while discharge port 322 is connected to a similar side port 326 (illustrated only in FIG. 5). Beneath the side ports 324 and 326 are located radial passages 328 (FIGS. 7A and 7B) and 330 (FIG. 5), respectively. As will be explained in detail hereinafter, radial passages 328 and 330 cooperate with discharge ports 320 and 322 in supplying pumping fluid to the upper cavity U.

A pair of lower discharge ports 332 and 336 are provided to supply pumping fluid to the lower pumping cavity L. A radial passage 334 is provided above the lower discharge port 332, and the radial passage 334 and lower discharge port 332 cooperate to supply pumping fluid to the lower pumping cavity, as will be described more fully hereinafter. A similar radial discharge port 338 is provided above port 336.

The axial outlet tube 250 includes a pair of raised flanges 340 and 342 formed on its outer surface. The flanges together define an annular channel 344 about the tube 250. As illustrated by the arrows in FIGS. 7A and 7B, the fluid supplied through supply tube 238 is directed through an opening 346 into the annular channel 344. Although not illustrated, the second supply tube 240 also directs pumping fluid into the channel 344.

When the outlet tube 250 is in its lowered position, as illustrated in FIG. 7A, the annular channel 344 is in communication with radial passage 328 so that fluid can flow upward into the upper discharge port 320, as illustrated by the arrows. Note that the pumping fluid is unable to flow into the lower discharge port 332 since side port 326 is blocked by the flange 306 formed about the inner wall of the cylindrical housing 212.

When the outlet tube 250 is in its upper position, as illustrated in FIG. 7B, the situation reverses. Flow from the annular channel 344 through side port 324 is blocked by the flange 306, while flow to the lower discharge port 332 is now provided through radial passage 334, as illustrated by the arrows.

A first low pressure port 350 is provided in the upper flange 340 on the outlet tube 250. A second low pressure port 352 is provided on the lower flange 342. When the outlet tube 250 is in its lower position, as illustrated in FIG. 7A, the low pressure port 352 is opened to the lower pumping cavity L and allows the pumping fluid which is trapped therein to be discharged as the piston assembly 260, 262 moves upward. The low pressure port 350, at the same time, is aligned with the radial passage 334. This assures that a low pressure zone exists above flange 306 which in turn assures that the partition 214 remains in its lower position (as illustrated in FIG. 7A).

When the outlet tube 250 is in its upper position, as illustrated in FIG. 7B, the configuration of the low pressure ports 350, 352 are reversed. The low pressure port 352 is aligned with radial passage 328 so that a low pressure zone is maintained on the underside of flange 306. This assures that the cylindrical housing 212 remains in its lowermost position relative to partition 214 (as illustrated in FIG. 7B). The upper low pressure port 350 is opened to the upper pumping cavity U so that the drive fluid entrapped can be discharged to the outlet tube as the pistons 260, 262 are lowered.

Referring now to FIGS. 8A–8E, the operation of the pump 200 will be described in detail. In FIG. 8A, the cylindrical housing 212 is in its lowermost position and the axial outlet tube 250 is in its uppermost position. Thus, the internal passages in the partition 214 are arranged as illustrated in FIG. 7B. Pumping fluid will be directed to the lower pumping cavity L while the drive fluid in the upper pumping cavity U will discharge through port 350 into the outlet tube 250. The pistons 260 and 262 will be driven downward and the fluid in the lower pumping cavity L will be pumped into the outlet tube 250 through the inlet 278.

The pistons 260 and 262 will continue to move downward until the lower surface of the upper piston 260 engages a spring 360 which is mounted on a shoulder 362 defined by the upper flange 340 on the outlet tube 250.

As the downward travel of the pistons 360 and 362 continues, the pressure exerted on the shoulder 362 by spring 360 causes the outlet tube 250 to move downward, as illustrated in FIG. 8C. This motion causes the annular channel 344 to move downward and out of communication with radial passage 334. Passage 334 is then connected to the low pressure port 350, as illustrated in FIG. 7A. Radial passage 328 is brought into communication with annular channel 344. The pumping fluid, however, does not yet reach the upper discharge port 320, since flow is blocked by flange 306. The high pressure of the pumping fluid is, however, exerted on the lower face of flange 306 which is experiencing a low pressure on its upper face through passages 350 and 334. This pressure differential causes the partition 214 to move downward, until the cylindrical housing 212, partition 214, and the outlet tube 250 assume the relative positions illustrated in FIG. 7A and 8D. At this point, pumping fluid begins to flow into the upper pumping cavity U, causing the pistons 260 and 262 to raise. Fluid in the lower pumping cavity L is discharged through port 352 formed in the outlet tube 250. The pistons 260 and 262 continue moving upward until a spring 364 is engaged by the upper surface of the lower piston 262. The force on the outlet tube 250 exerted by spring 364 (through a shoulder 366 defined by lower flange 342) will shift the outlet tube upward, causing the internal passages to reverse and initiating pump cycle once again.

A ball valve 270 is provided at the upper end of the axial passage 246. The ball valve prevents reverse flow of the fluid being pumped while the positions of the cylindrical housing 212 and outlet tube 250 are being reversed.

Although the foregoing invention has been described in some detail by way of illustration and example for purposes of clarity and understanding, it will be obvious that certain changes and modifications may be practiced within the scope of the appended claims.

What is claimed is:

1. A pump comprising:

an elongate cylinder which is open at each end;

a partition attached to the cylinder and dividing said cylinder into approximately equal halves;

an outlet tube axially aligned with the cylinder at its center and defining a fluid path through the partition;

an upper end plate spaced-apart from one end of the cylinder and the return tube, said upper end plate having an outlet passage substantially aligned with the return tube;

a lower end plate spaced apart from the other ends of the cylinder and return tube;

upper and lower pistons mounted to reciprocate within the cylinder on either side of the partition, said pistons being attached to each other to move in unison;

means for reciprocating the pistons; and means for alternately sealing (1) the cylinder against the upper end plate and the return tube against the lower end plate, or (2) the cylinder against the lower end plate and the return tube against the upper end plate, whereby the reciprocation of the piston will alternately (1) draw fluid into the lower half of the cylinder and discharge fluid from the upper half into the outlet passage, or (2) draw fluid into the upper half of the cylinder and discharge fluid from the lower half of the cylinder and into the outlet passage through the return tube.

2. A pump as in claim 1, wherein the means for alternatly sealing comprises four valve rings, one mounted at each end of both the elongate cylinder and the outlet tube, the valve rings being actuated to open and close in a predesired pattern by the pressure changes induced by reciprocation of the pistons.

3. A pump as in claim 1, wherein the means for alternately sealing is defined by shiftably mounting both the elongate cylinder and the outlet tube so that they will selectively seal against the upper and lower end plates in response to the means for reciprocating the pistons.

4. A pump as in claim 1, wherein the means for reciprocating the pistons comprises valve means for alternately directing a pumping fluid to the interstitial space between the upper piston and the partition and the interstitial space between the lower piston and the partition.

* * * * *